US005894756A

United States Patent [19]

Uehara et al.

[11] Patent Number: 5,894,756

[45] Date of Patent: Apr. 20, 1999

[54] GOVERNOR SYSTEM FOR ENGINE STARTER MECHANISM

[75] Inventors: Shuji Uehara; Hiroshi Hiruma; Ryuichi Toya, all of Gunma-Ken, Japan

[73] Assignee: Mitsuba Corporation, Kiryu, Japan

[21] Appl. No.: 08/824,348

[22] Filed: Mar. 26, 1997

[30] Foreign Application Priority Data

Apr. 2, 1996 [JP] Japan ..... 8-104531
Jun. 26, 1996 [JP] Japan ..... 8-188945

[51] Int. Cl.[6] ..... F02N 15/06

[52] U.S. Cl. ..... 74/7 B; 74/76; 74/7 R; 192/114 R

[58] Field of Search ..... 74/7 C, 7 R, 7 B; 192/114 R

[56] References Cited

U.S. PATENT DOCUMENTS 4,325,265 4/1982 Wakatsuki ..... 74/7 R
4,738,148 4/1988 Norton ..... 74/7 B
4,924,717 5/1990 Aimo ..... 74/7 B

FOREIGN PATENT DOCUMENTS

B 2-14547 4/1990 Japan .
B 3-75750 12/1991 Japan .
5-11216 2/1993 Japan .
6-31182 8/1994 Japan .

*Primary Examiner*—Charles A. Marmor
*Assistant Examiner*—Ankur Parekh
*Attorney, Agent, or Firm*—Oliff & Berridge, PLC

[57] ABSTRACT

A governor system is provided for engine starter mechanisms to prevent a premature retracting movement of a single-direction rotatable clutch. The governor system is constructed with a reduced number of parts and such that a clutch does not suffer from the increased angular momentum as it rotates together with a governor weight. The governor system includes a casing or a bracket fixed to a driven gear, with the governor weight received in the casing. The governor weight is provided with a first and a second weight portion which are different in weight from each other such that the center of gravity of the governor weight is disposed radially eccentric. When the rotatable clutch rotates to advance and moves out of a receptacle hole of the governor weight, simultaneously the governor weight rotates to shift in one radially outward direction toward said first or heavier weight portion, the second or lighter weight portion enters into the retracting passage of an advanced inner clutch base portion, thereby preventing the rotatable clutch from retracting prematurely to the initial position.

14 Claims, 11 Drawing Sheets

GOVERNOR SYSTEM FOR ENGINE STARTER MECHANISM

BACKGROUND OF THE INVENTION

1. Field of Invention

The present invention relates to a governor system for engine starters of automobiles and motorcycles.

More particularly, the present invention relates to an improved governor system which, with a simple construction, can reliably prevent undesirable premature retracting movement of the rotating clutch.

The present invention also relates to an improved governor system which, with a simple construction, permits reduction of impact to the clutch when it is brought into intermeshing engagement with the input gear of the engine.

2. Description of Related Art

There is one known governor system including the single-direction rotation clutch operatively connected to the motor driven gear shaft via a helical spline disposed on the gear shaft, in which the inner and outer clutch members rotate together with the rotation shaft to transmit rotation to the engine, and the clutch is moved forward along the helical spline by the angular momentum of the motor to thereby bring the pinion gear disposed at its front portion into intermeshing engagement with the ring gear provided at the engine for starting the same.

This known engine starter is provided with the governor system to prevent retracting movement of the pinion gear to prevent undesirable retracting movement of the one way rotation clutch during operation. The governor system includes a governor weight means disposed at the rear portion of the clutch such that the governor weight means moves forward as the clutch moves forward while rotating. Then at this forward position, the weight means is displaced radially outwards by the centrifugal force of the clutch rotation. Thus, the displaced weight means engages with a stepped portion of the open end of the governor casing or receptacle so as to be locked and prevented from retracting itself. This known mechanism is constructed such that the governor weight moves forward together with the clutch, and thus the engagement of the weight means against the clutch increases the total weight of the rotating mass, which consequently increases the angular momentum of the clutch. This increased momentum leads to an adversely increased impact upon the pinion gear and the ring gear when they intermesh with each other.

Japanese Examined Patent Publications Nos. 2-14547 and 3-75750 disclose a governor system having a weight means composed of a pair of separate arc shaped governor weight members rotatably supported respectively such that the center of gravity of the governor weight means is located eccentrically or off the rotation axis. In this arrangement, a heavier member of the weight means located at one radial side of the gear shaft moves outwardly due to the centrifugal force of the gear shaft rotation, thus causing the other member or lighter member at the opposite radial side of the shaft to move inwardly or toward the latter, thereby preventing the clutch from moving rearwardly in the axial direction to the retracted position.

SUMMARY OF THE INVENTION

It is therefore an object of the present invention to provide a governor system which, with a simple construction, can reliably prevent undesirable premature retracting movement of the rotating clutch. Conventional governor systems include a pair of weight members supported separately, thus requiring additional supporting parts which in turn makes the mechanism more complicated in structure and impairs the efficiency of assembly. The present invention is proposed to solve such drawbacks of the mechanism.

It is another object of the present invention to provide a governor system which, with a simple construction, permits reduction of impact to the clutch when it is brought into intermeshing engagement with the input gear of the engine.

The invented governor system for engine starting mechanisms includes a motor driven gear shaft and a single-direction rotatable clutch operatively engaged with the gear shaft via a helical spline means such that the clutch rotates together with the gear shaft as the latter is driven to rotate and then the clutch moves forward due to the momentum of rotation to transmit the rotation via a pinion gear to the engine for thereby starting the same, such that the clutch rotates only in an idling manner without transmitting rotation when the gear shaft is inactive.

In addition to the above-mentioned structure, the present governor system, for preventing a premature retracting movement of the clutch, comprises: an integral governor weight means movable in a radial direction of the gear shaft due to a centrifugal force caused by rotation of the gear shaft; and a resilient position-restoring means urging the governor weight means radially inwards to return to an initial retracted position when the centrifugal force diminishes. The governor weight means has an annular shaped body in which a base portion of the clutch is received when the latter is at the initial retracted position, the base portion being movable into and out of the annular shaped body in the axial direction; and the weight means having a pair of radially confronting weight members of different weight such that its center of gravity is eccentric or located off axis so that the centrifugal force of rotation causes the weight means to shift in one radial direction creating one heavier member side, and thus, the other lighter weight member moves toward the gear shaft thereby preventing axial retracting movement of the clutch.

With this arrangement, the governor weight means works suitably enough to prevent the single-directional rotation clutch from prematurely retracting as well as requiring a reduced number of parts thereby improving the efficiency of assemblage of the system.

In the governor system according to the present invention, the governor weight means has a bracket or casing integrally rotatable with the gear shaft, and the governor weight means is disposed against the bracket slidably movable in the radial direction, the bracket having a guide for guiding the governor weight means in one radial direction.

The present invention further provides a governor weight means having a heavier weight portion at one side of the rotation axis and a lighter weight portion disposed on the radially opposite side so that the center of gravity is displaced off the rotation axis, enabling the lighter weight portion to prevent premature retracting movement of the clutch. This governor arrangement further enables the starter mechanism to minimize adverse impact which is caused in conventional mechanisms when the clutch is brought into intermeshing engagement with the input engine gear. In conventional mechanisms the impact is larger because the accompanying rotation of the governor weight with the clutch produces an increased load or mass of rotation.

The present invention moreover enables a simplified structure by providing a receptacle room for receiving the resilient position restoring device such that the receptacle room is formed jointly by and between the bracket and the governor weight means.

BRIEF DESCRIPTION OF THE DRAWINGS

The above and other objects, and advantageous features of the present invention will be apparent from the following detailed description of the preferred embodiments when read with reference to the accompanying drawings.

DETAILED DESCRIPTION OF PREFERRED EMBODIMENTS

Figure 1:
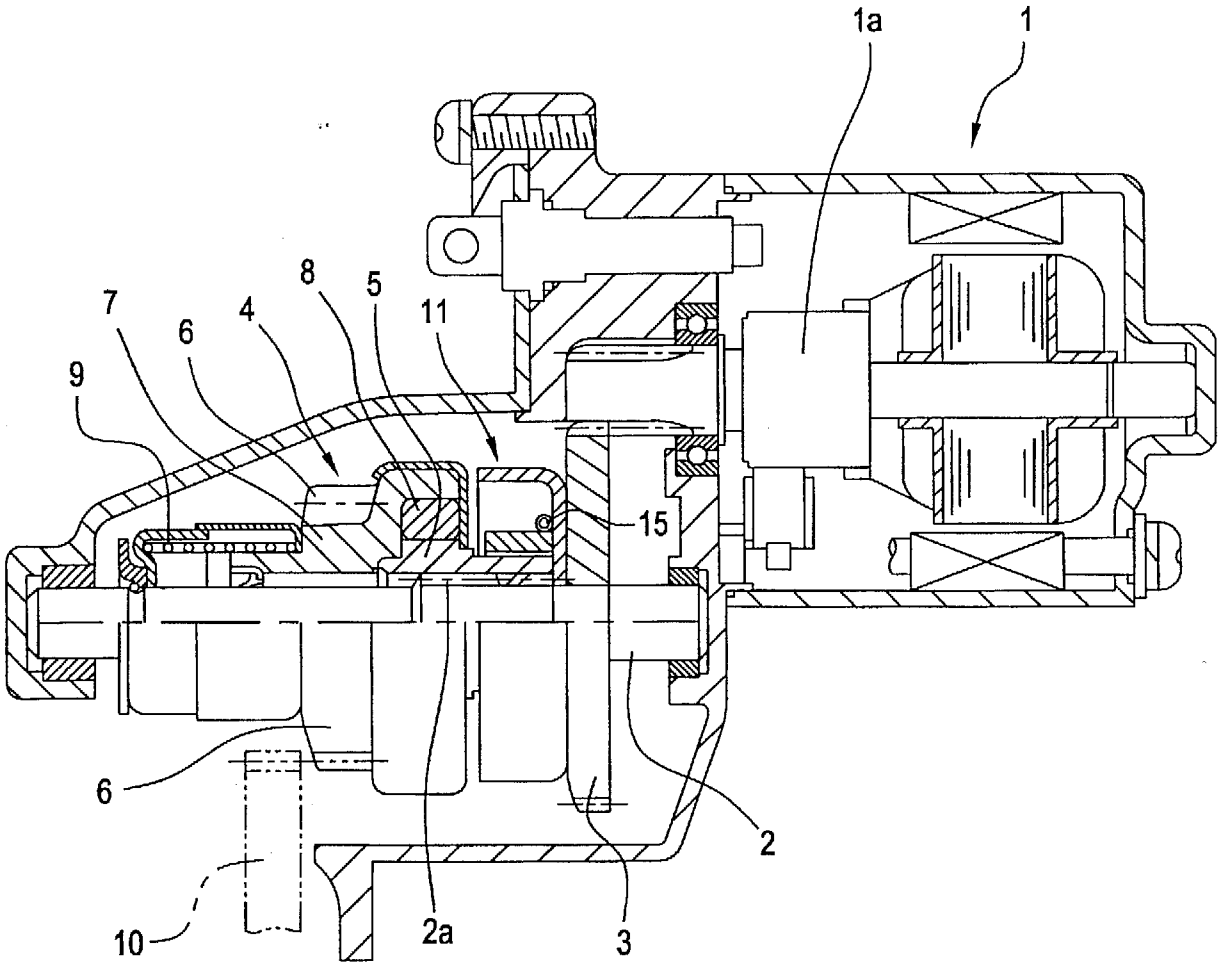
FIG. 1 is a partly sectional side view showing the engine starter mechanism provided with a governor system according to a first embodiment of the present invention.

A first preferred embodiment of the invention will now be explained hereinbelow with reference to the accompanying drawings FIGS. 1–5. In FIG. 1, an engine starter mechanism denoted by numeral 1 has a transmission mechanism in that a motor 1*a* is operatively connected to an output gear shaft 2 via a driven gear 3 formed integrally on the gear shaft 2 thereby transmitting the rotation force of the motor to the gear shaft 2. The gear shaft 2 has a helical spline 2*a* formed on the shaft, and a single-direction rotation clutch 4 which is movably fitted in the helical spline 2*a*.

The single-direction rotation clutch 4 includes an inner clutch member 5 operatively engaged with the helical spline 2*a*, an outer clutch member 7 provided integrally with a pinion gear 6 over the outer periphery thereof, a clutch roller 8 interposed between the outer and inner clutch members 5, 7, and other various clutch members. The inner and outer clutch members and the roller 8 are disposed coaxially about the shaft 2, and the inner clutch member 5 has an annular base portion 5*a*, best shown in FIG. 2, extending axially rearwardly. In active mode of this arrangement when the motor 1*a* is actuated to rotate the gear shaft 2 in one direction, the clutch roller 8 engages tightly with the inner and outer clutch members 5, 7 therebetween, thereby rotating the inner and outer clutch members together integrally. In contrast, in inactive mode when the gear shaft 2 and the motor 1*a* rotate in the opposite direction, the clutch roller 8 rotates in an idling manner thereby allowing the inner and outer clutch members to rotate freely from each other.

The starter mechanism is provided with a compression spring or position restoring device 9 which urges the clutch to a retracted inactive position, where, as described later in detail, the clutch abuts against a bottom face 12*a* of a bracket or casing 12 (as shown in the upper half of FIG. 2) and the pinion gear 6 is positioned out of intermeshing engagement with an input gear 10. When the motor 1*a* is activated to rotate the output gear shaft 2 and its rotation force is transmitted to the single-direction rotatable clutch 4 through cooperative functioning of the inner and outer clutch members 5, 7 and the roller 8, the clutch moves forward along the helical spline 2*a* to an active forward position (as shown in the lower half of FIG. 2) against the urging force of the compression spring 9 due to angular momentum, thereby bringing the pinion gear 6 into intermeshing engagement with the input gear 10 for starting the engine (not shown). Then, as the motor is inactivated to stop, the clutch moves back to the retracted position due to the resilient force of the compression spring 9. This retracting mechanism functions in a similar manner to the prior art.

Figure 3:
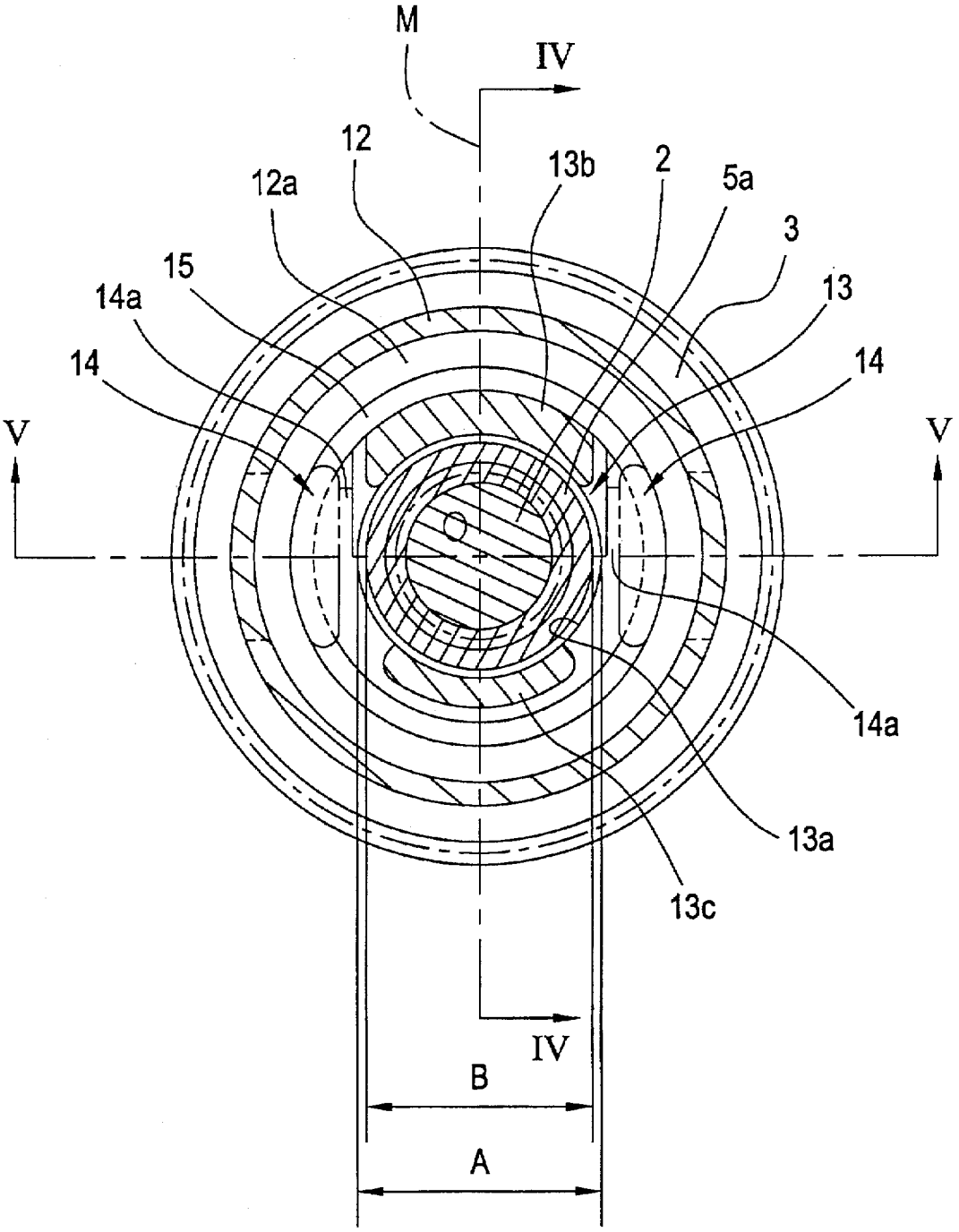
FIG. 3 is a cross-sectional view taken along the line III—III in FIG. 2.
Figure 4A:
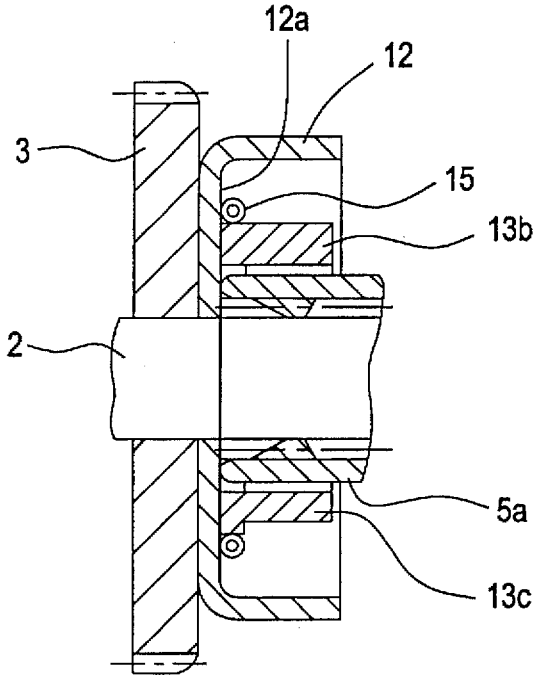
FIG. 4A is a cross-sectional view taken along the line IV—IV in FIG. 3.
Figure 4B:
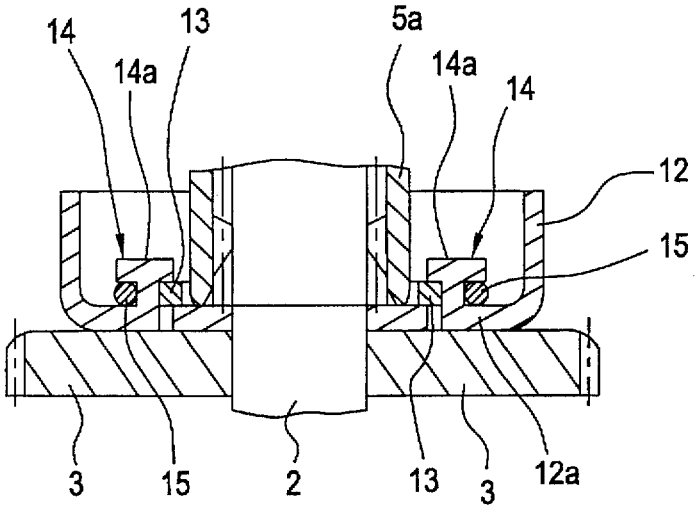
FIG. 4B is a cross-sectional view taken along the line V—V in FIG. 3.

A governor system denoted by numeral 11 includes a flanged casing or bracket 12 and a governor weight means 13. The bracket 12 has a bottom wall 12*a* fixed integrally on the front face of the driven gear 3 so as to rotate integrally with the gear shaft 2. The governor weight means 13 is received in the bracket 12 and supported slidably movably on the bottom wall 12*a*. The governor weight means 13 has an annular shaped body having a central aperture 13*a* shown in FIG. 3, and passing therethrough for receiving the base portion 5*a* of the inner clutch member 5. The aperture 13*a* has an inner diameter A larger than an outer diameter B of the base portion 5*a* to allow inner clutch member 5 to move free from any hindrance of the governor weight means 13. As shown in FIG. 3, the weight means 13 has a symmetrical configuration about a center axis M crossing an axis 0 of the shaft 2 at right angles (vertical in the drawing). The weight means 13 has a first weight balancer 13*b* at one radial side of the axis 0 (upper side of the vertical center axis M in the drawing) and a second weight balancer 13*c* at the radially opposite side (lower side of the vertical axis M in the drawing), both of the balancers extending along a circle about the shaft 2 in an arc shape, and each having a width extending axially toward the single-direction rotatable clutch 4.

Figure 2:
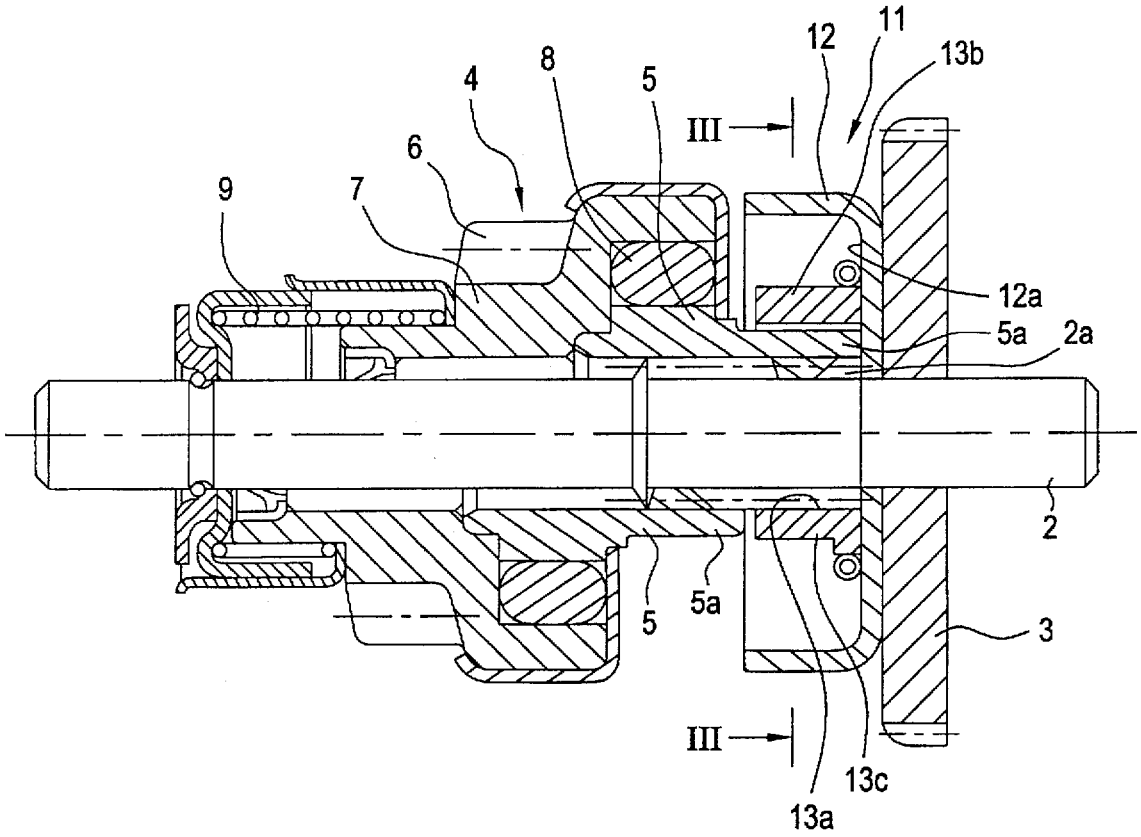
FIG. 2 is a cross-sectional side view showing the structure and operation of the principal parts of the mechanism.

When the clutch 4 is in the inactive or retracted position, the base portion 5*a* of the inner clutch member 5 is received within the aperture 13*a* such that the first and second weight balancers 13*b*, 13*c* overlap the base portion 5*a* as shown in the upper half of the drawing in FIG. 2. In contrast, when the clutch 4 moves forward to the active forward position, the inner clutch base portion 5*a* is positioned completely clear of the forward end of the weight balancers 13*b*, 13*c*, namely, clear of the entire width thereof.

In addition, the first weight balancer 13*b* has a weight heavier than that of the second weight balancer 13*c* such that the center of gravity of the governor weight means is eccentric to the rotation axis thereof toward the first balancer 13*b* to thereby bias the governor weight means in one radially outward direction as it rotates.

Figure 5A:
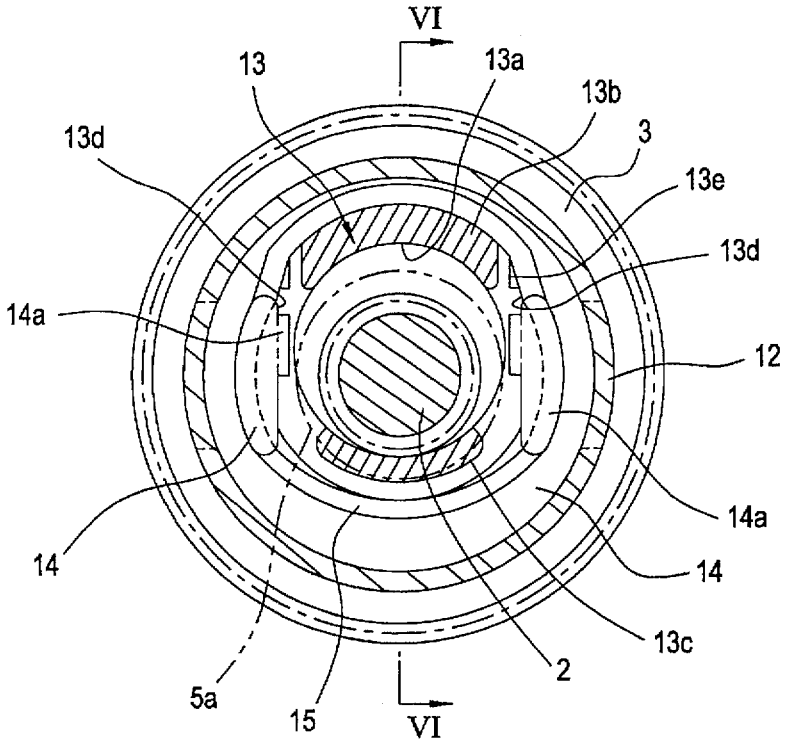
FIG. 5A is a cross-sectional view taken along the line III—III in FIG. 2 showing the proposed system in active mode.

Moreover the governor weight means 13 is provided with a pair of linear guide portions 13*d*, 13*d*, shown in FIG. 5(A), which are formed by partially cutting off the outer periphery thereof between the first and second weight balancers 13*b*, 13*c* and extend linearly parallel with the center axis M.

Figure 5B:
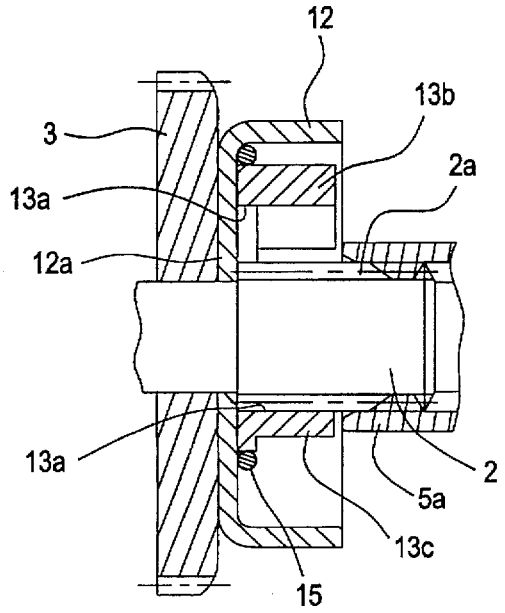
FIG. 5B is a cross-sectional view taken along the line VI—VI in FIG. 5A.

The bracket has a pair of guide projections 14, 14 formed integrally on the bottom wall 12*a* for guiding the linear guide portions 13*d*, and for limiting their movement to movement in the direction of the center axis M. There is also provided a position restoring device or annular spring 15 extending over the periphery of the governor weight means 13 and the periphery of the pair of guide projections 14, 14 as best shown in FIGS. 5A, 5B so that the governor weight is urged to stay at a position coaxial with the gear shaft 2. Numeral 14*a* in FIGS. 3 and 4(B) denotes a pair of stoppers formed on the guide projections 14, 14 for preventing the governor weight means 13 from coming out of the bracket 12 accidentally.

In operation, the axis of the governor weight means 13 is forced to shift radially outwards off the axis of the rotation gear shaft, namely, toward the first or heavier weight balancer 13*b* when the motor 1*a* is activated to rotate the gear shaft 2. At this time, the one way rotatable clutch 4 advances to the forward position, and the rear end of the base portion 5*a* of the inner clutch member comes completely out of the governor weight means 13, more specifically out of the aperture 13*a*, and the governor weight means shifts in one radially outward direction or toward the first weight balancer 13*b* due to centrifugal force against the bias of the annular spring 15 while the inner periphery of the second weight balancer is brought into engagement with the shaft 2. In this mode, the forward end of the second weight balancer 13*c* stays in the retraction path of the base portion 5*a* of the clutch 4 and blocks the same if the clutch would return to the initial inactive position prematurely.

In assembly, the governor weight 13 of the governor system according to the present invention is mounted to the bracket 12 before bracket 12 is mounted to the gear shaft 2. More specifically, the guides 13*d* of the governor weight 13 have a further cut-off portion or recess 13*e* (shown in FIG. 5(A)), relatively closer to the first weight balancer 13*b*. With this arrangement, the governor weight means 13 is first placed in such a position that the axis of the same 13 is located substantially away from the rotation axis 0 of the starter mechanism in a radial direction toward the second weight balancer 13*c* (downward in FIG. 3) without any hindrance from the gear shaft 2 as the latter has not yet been mounted at this stage. The recesses 13*e*, 13*e* allow this placement of the weight means 13 as it passes a corresponding corner of the guide projections 14,14 without being blocked. Then the weight means is slid sideways toward the first weight balancer 13*b* to a central position where the guide projections 14, 14 of the bracket 12 prohibit the weight means 13 from coming out of the bracket 12, particularly in the axial direction.

In operation of the starter mechanism, first the starter motor 1*a* is activated to rotate the driven gear 3 and the gear shaft 2 cooperatively, which activates the one direction rotatable clutch 4 to move forward along the helical spline 2 due to angular momentum, thus bringing the pinion gear 6 into intermeshing engagement with the input gear 10 thereby starting the engine. As described above, at this time the one way rotatable clutch 4 advances to the forward position and the rear end of the base portion 5*a* of the inner clutch member comes completely out of the governor weight means 13, and the governor weight means shifts in a radially outward direction or toward the first weight balancer 13*b* due to centrifugal force against the bias of the annular spring 15 while the inner periphery of the second weight balancer is brought into engagement with the shaft 2. In this mode, the forward end of the second weight balancer 13*c* blocks the base portion of the clutch 4 by staying in its retraction path if the clutch would return to the initial inactive position prematurely.

With this simple arrangement, the governor weight means 13 is able to prevent premature retracting movement of the one direction rotatable clutch 4. However, the invented governor system does not advance with the clutch 4 in the axial direction, which enables the system to avoid an increase in angular momentum of the clutch which otherwise would be experienced due to an increased mass of the rotating object. The present system successfully avoids such an increase in angular momentum and mass which usually occurs in a conventional system, and thus minimizes the degree of impact during intermeshing engagement from which the pinion gear of the clutch and the input gear of engine would otherwise suffer.

Moreover, the present governor weight means 13 is integrally formed in an annular shape and provided with first and second weight balancers 13*b*, 13*c* which shift in an eccentric manner as they rotate. The present governor system therefore has a simple structure composed of a relatively reduced number of parts, and thus enables improved assembling efficiency of the system 11 compared with conventional governor systems with complicated structures in which various separate weight members are operatively supported in an eccentric manner.

The scope of the present invention is not limited to the above-described embodiment. FIGS. 6–9 show a second embodiment of the present invention. In this embodiment, the same numerals as used in the first embodiment indicate similar parts, which will not be explained in detail again.

Figure 6B:
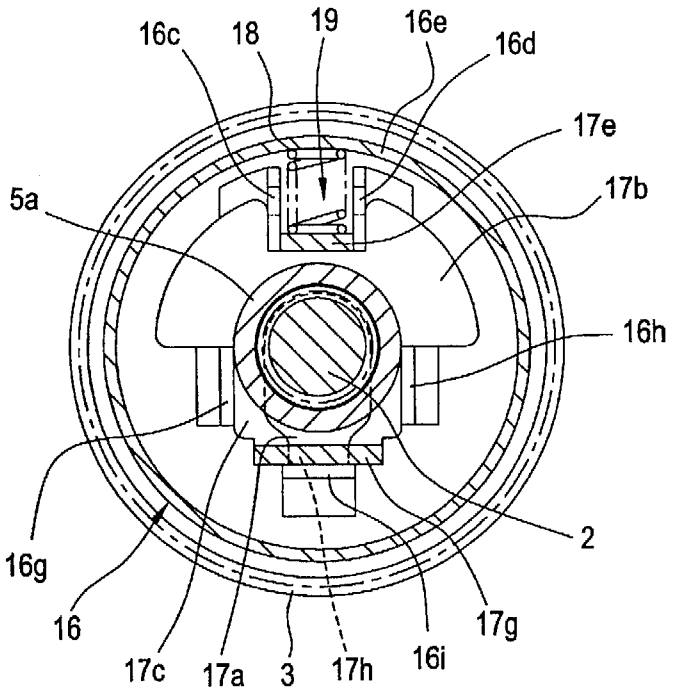
FIG. 6B is a cross-sectional view taken along the line VII—VII in FIG. 6A.
Figure 6A:
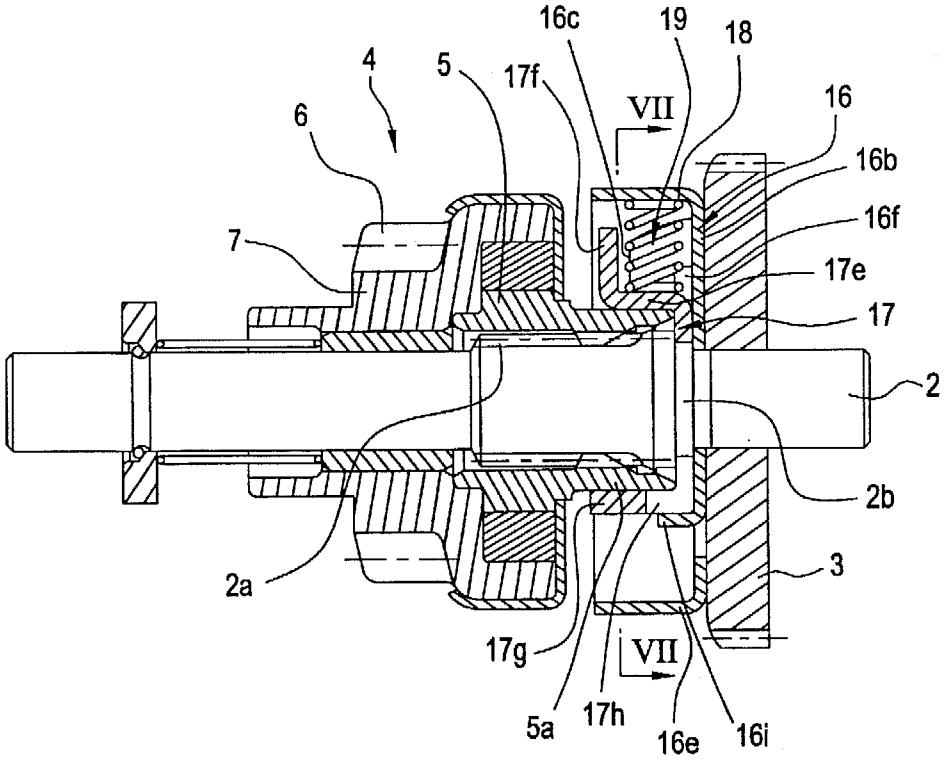
FIG. 6A is a cross-sectional side view of an engine starter mechanism provided with a governor system according to a second embodiment of the present invention, shown in inactive mode.
Figure 7B:
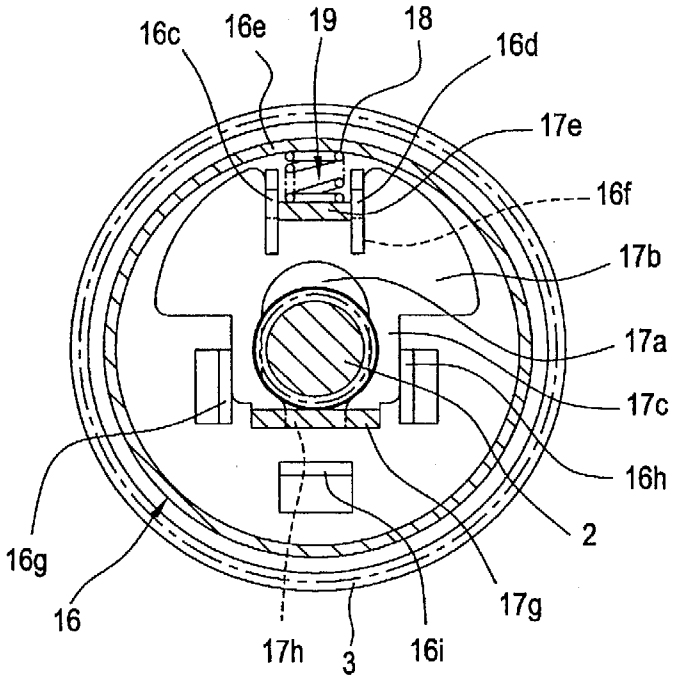
FIG. 7B is a cross-sectional view taken along the line VIII—VIII in FIG. 7A.
Figure 7A:
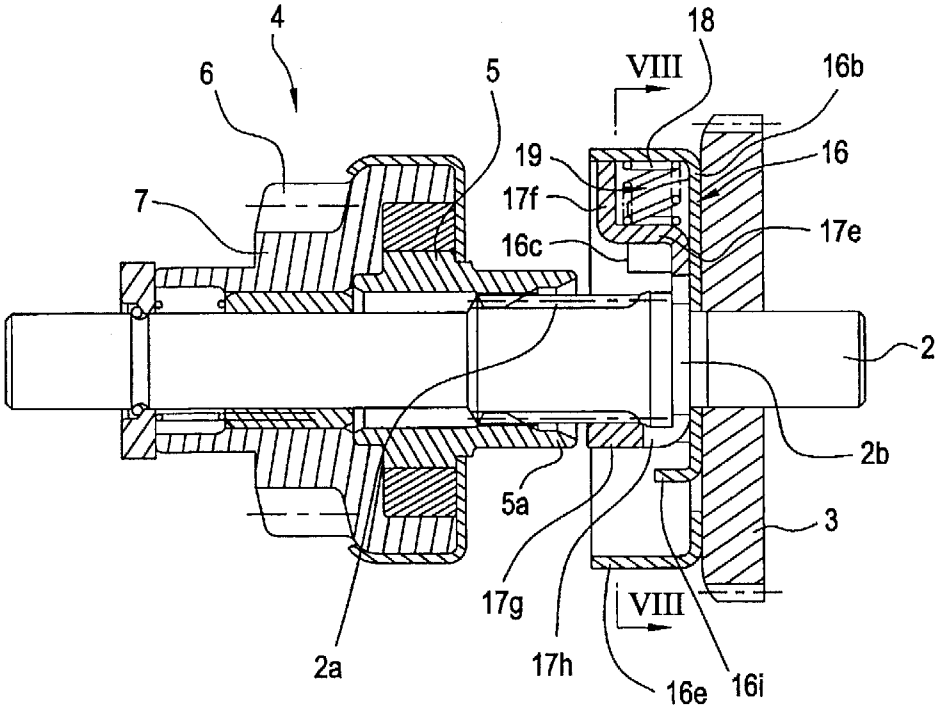
FIG. 7A is a cross-sectional side view of the governor system according to the second embodiment shown in active mode.

In FIGS. 6A and 6B, bracket or casing 16 which is fixed integrally onto the front face of the driven gear 3 has a circular bottom wall similar to the first embodiment, and the bracket 16 is formed by a mechanical press. The same manufacturing method can be used for a governor weight means 17. A position restoring device 18 for urging the governor weight 17 to an initial inactive position is composed of a compression coil spring 18. The coil spring 18 is contained within a room 19 defined by the bracket 16 and a heavier weight balancer that is positioned as described in detail hereinbelow.

Figure 8A:
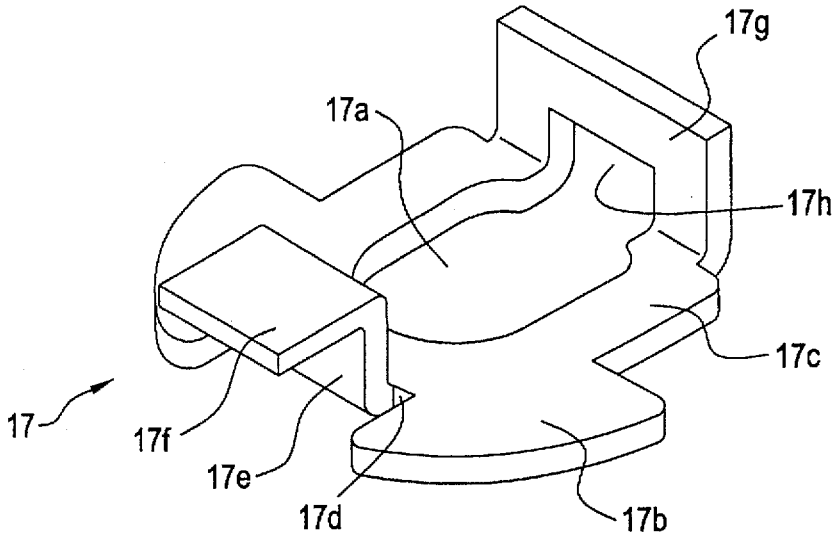
FIG. 8A is a perspective view of the governor system according to the second embodiment.
Figure 8B:
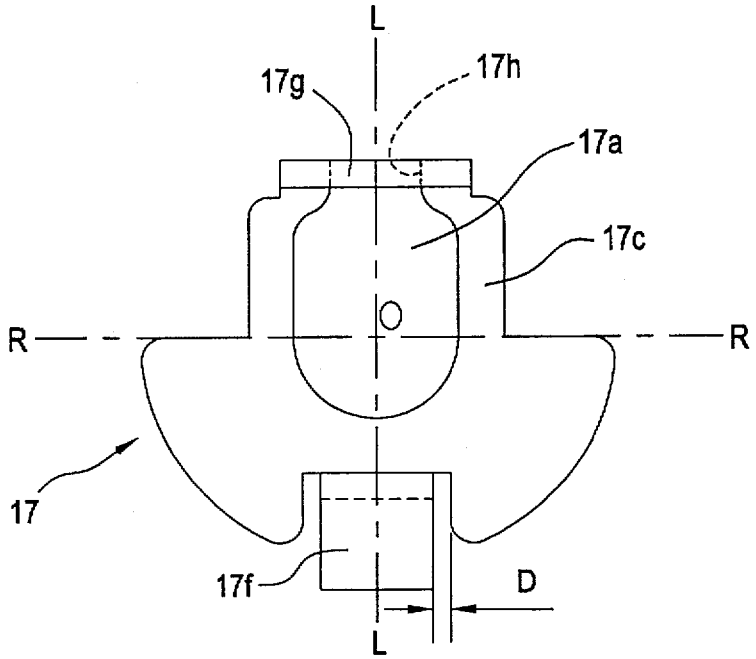
FIG. 8B is a top view of the system shown FIG. 8A.

As best shown in FIGS. 8A and 8B, the governor weight means 17 is linearly symmetrical about a center axis L-L crossing the rotation axis 0 at right angles and includes a first heavier weight balancer 17*b* of a relatively larger area and a second lighter weight balancer 17*c* of a relatively smaller area. The two weight balancers 17*b* and 17*c* are merged with each other along a phantom linear line R-R crossing the center axis at right angles to the axis 0. An aperture 17*a* is defined central to the governor weight 17 and extends along the center axis L-L to form an oblong circular opening. The aperture receives a guide shaft portion 2b of the gear shaft 2 for allowing the governor weight 17 to move freely in one axial direction (along the center axis L-L).

The first weight balancer 17b has a semicircular body extending radially outward opposite to the second balancer 17c. The first balancer 17b also has a leg or standing wall 17e extending from the general plane of the governor weight in the direction of the rotation axis, i.e. toward the one way rotatable clutch 4, such that the standing wall is located on the center axis L-L opposite to the second balancer 17c, as best shown in FIG. 8B. The standing wall 17e partially divides the semicircular area of the first balancer 17b and defines a pair of clearances 17d, 17d on both sides thereof together with the divided portion of the semicircular area. A side wall or foot 17f extends radially outward from the raised end of the standing wall 17e.

The second weight balancer 17c having a smaller width and area than that of the first balancer 17b includes a second standing wall or stopper 17g on a radially opposite side to the first standing wall 17e and extending toward the rotatable clutch 4 for preventing premature retracting movements of the clutch 4. Both the standing walls 17e and 17g can be formed by press-bending. The second standing wall 17g also has an aperture 17h communicating with the oblong aperture 17a.

Figure 9A:
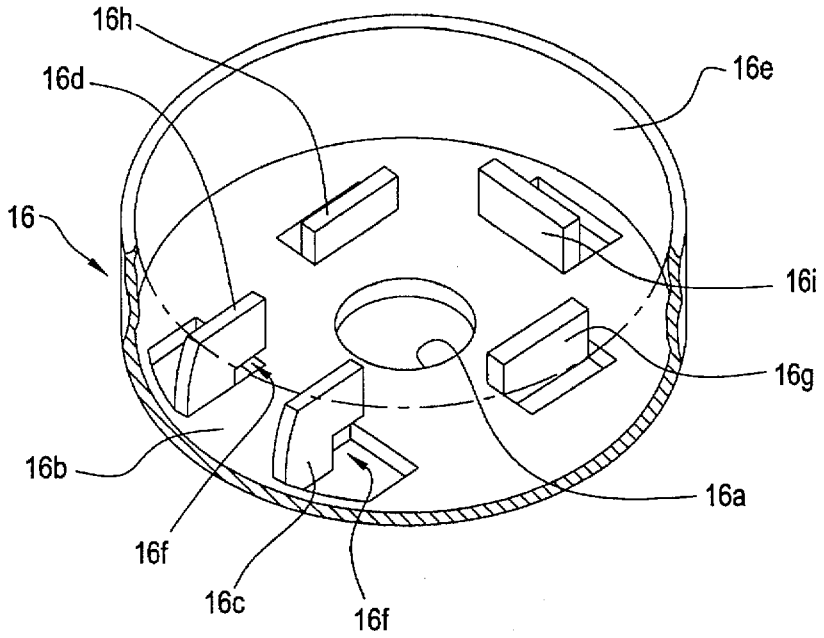
FIG. 9A is a perspective view of a bracket according to the second embodiment.
Figure 9B:
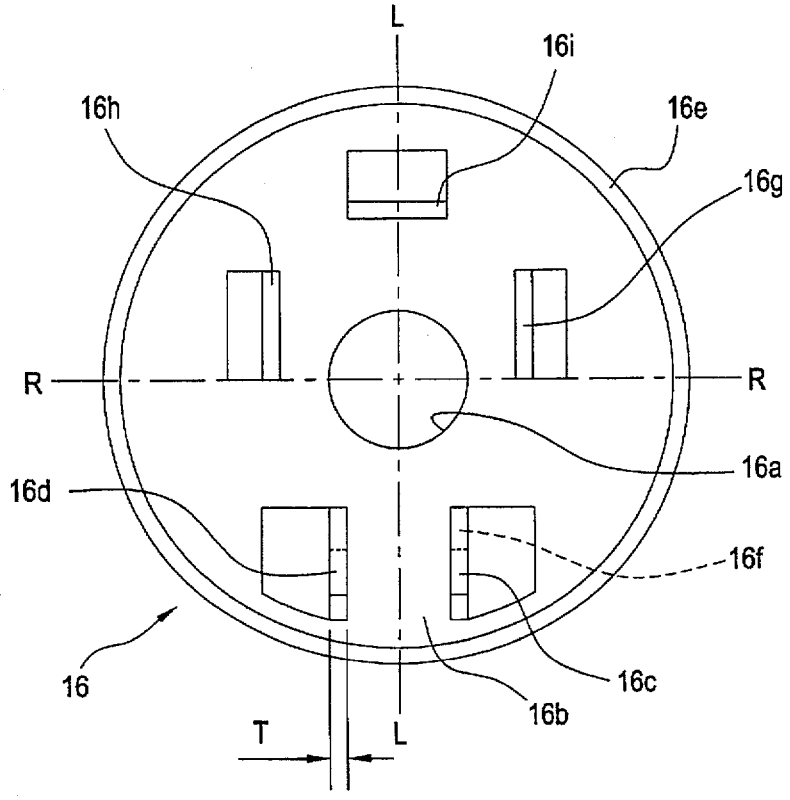
FIG. 9B is a top view of the bracket shown FIG. 9A.
Figure 10A:
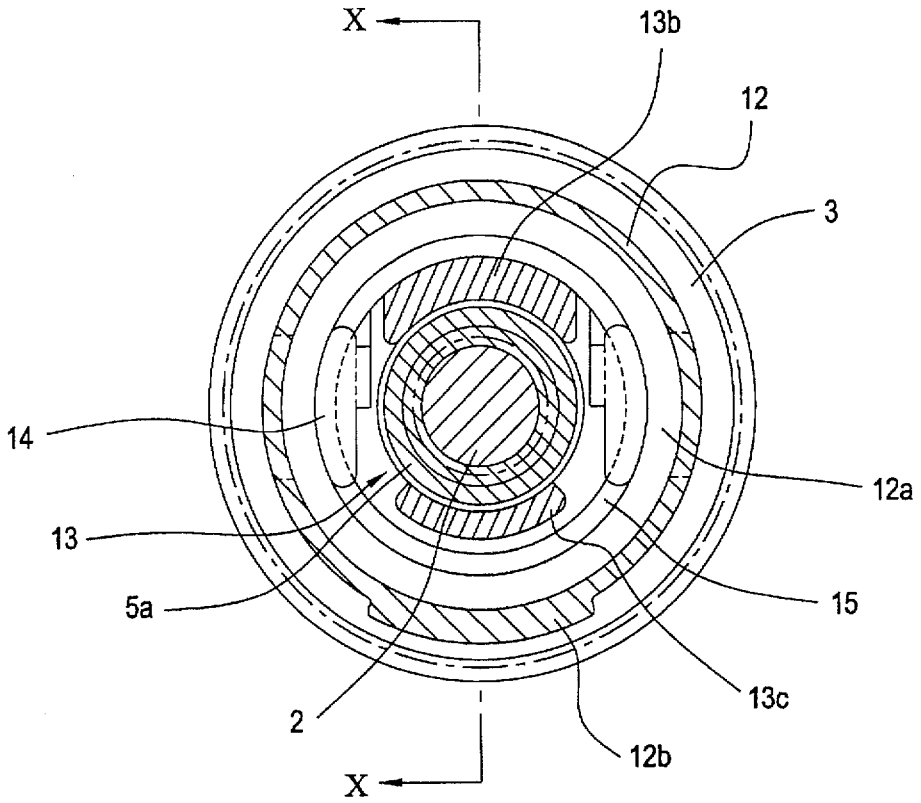
FIG. 10A is a cross-sectional front view showing a principal part of a governor system according to a third embodiment of the present invention.
Figure 10B:
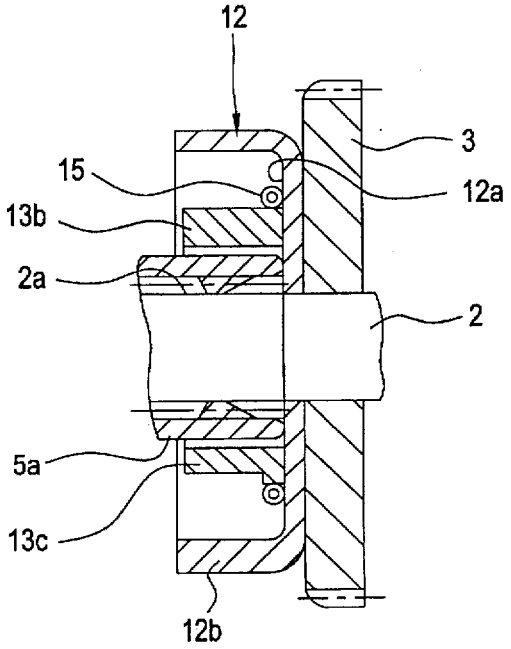
FIG. 10B is a cross-sectional view taken along the line X—X in FIG. 10A.
Figure 11A:
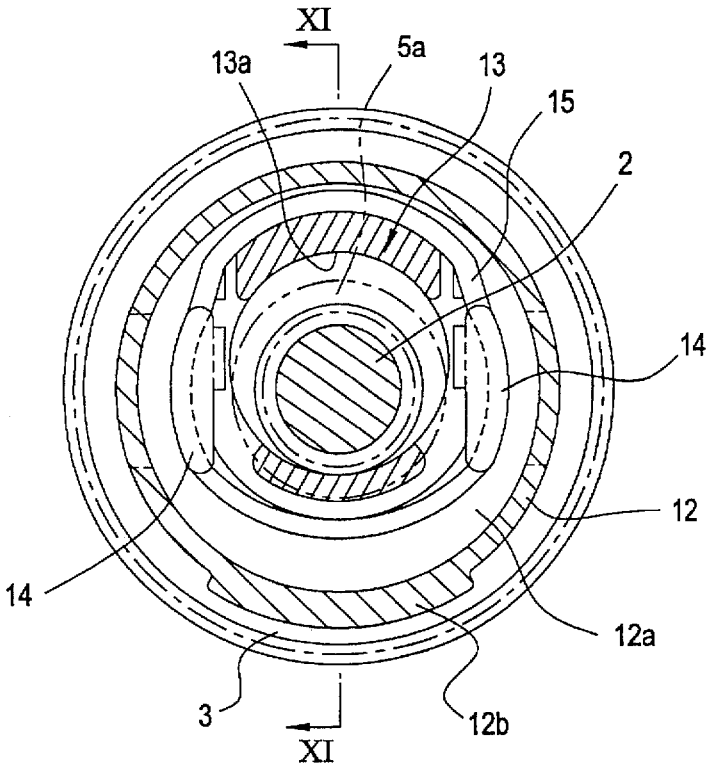
FIG. 11A is a cross-sectional front view showing the principal parts of the system of the third embodiment shown in active mode.
Figure 11B:
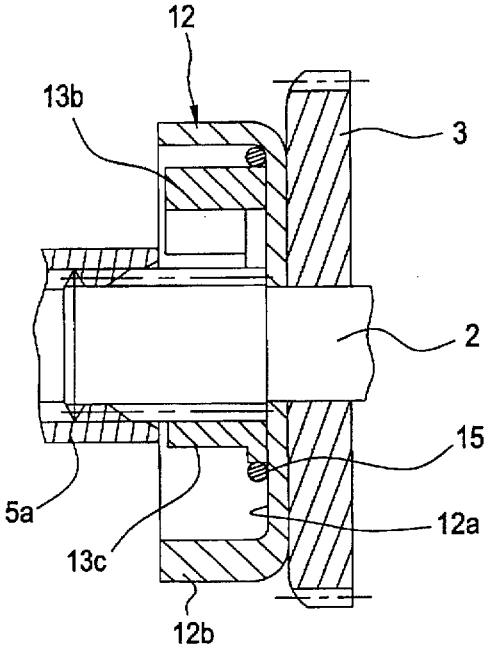
FIG. 11B is a cross-sectional view taken along the line XI—XI in FIG. 11A.

As best shown in FIGS. 9A and 9B, the bracket 16 has a central through hole 16a through which the gear shaft 2 is assembled to pass. The bracket 16 also provides a spring holder room 19 for accommodating the compression spring 18 therein in cooperation with the first standing wall 17e and the side wall 17f of the first weight balancer 17b. More specifically, a pair of third and fourth standing walls 16c, 16d are formed at a position on the bracket bottom wall corresponding to the clearances 17d, 17d of the first balancer 17b such that when the governor weight means 17 is mounted on the bracket 16, both ends of the first standing wall or leg 17e are faced by the third and fourth standing walls 16c, 16d. Each of the third and fourth walls have rounded standing edges as the wall portion is cut and raised from the bottom plate along the flanged inner periphery wall of the bracket 16. In this position the side wall 17f is located to face against a flat bottom portion 16b of the bracket, thereby defining all four sides of the spring holder room 19 in cooperation with the third and fourth standing walls 16c, 16d and the flat bottom portion 16b. Further, the first standing wall 17e located radially inward and a flanged portion or peripheral wall 16e of the bracket 16 jointly provide pressure surfaces retaining the compression coil spring 18.

As shown in FIG. 8B, both of the clearances 17d have such a width D as to guide and allow the third and fourth walls 16c, 16d, to move freely in the direction parallel with the center axis L-L. The width D is almost equal to the a thickness T in FIG. 9B. The standing walls 16c, 16d have a recess 16f for receiving an edge portion of the first weight balancer 17b to allow free movement thereof.

A pair of guide walls 16g, 16h, are also provided on the bracket bottom plate such that the second weight balancer 17c is interposed between the two guide walls 16g, 16h, thereby guiding the same along both side edges. A stopper wall 16i is formed on the bottom plate so as to face against the stopper 17g of the second weight balancer 17c. For assembly, the stopper wall 16i works to retain the governor weight means 17 in the bracket 16 as compression spring 18 pushes governor weight means 17 tightly against bracket 16 by pressing the preventive stopper 17g of the governor weight 17 against the stopper wall 16i. Thus the bracket 16 and the governor weight can be handled as one unit, which enables easy mounting of the two systems to the gear shaft 2.

Back in FIGS. 6A and 6B, the operation of this embodiment is explained hereinbelow. With the motor turned off, the weight governor means 17 is positioned in an initial inactive position where the preventive stopper 17g is urged by the coil spring 18 in the room 19 to abut against the stopper wall 16i. In this position, the stopper 17g rests over the periphery of the clutch base portion 5a in an overlapped manner. According to this embodiment, the stopper wall 16i blocks radially biased movement of the governor weight by the coil spring 18. Alternatively, this biased movement may be blocked by the shaft portion 2b and the inner peripheral edge 17a of the first weight balancer 17b.

When the motor is activated to rotate the gear shaft 2, the one way rotatable clutch 4 rotates moving forward along the helical spline 2a bringing the pinion gear into intermeshing engagement with the input gear 10 to start the engine. These processes to this point are the same as the first embodiment. When the clutch 4 moves out of the governor weight means 17, the latter shifts eccentrically to move the first heavier weight balancer 17b radially outward against the bias force of the compression spring 18, and at the same time the stopper 17g of the second lighter weight balancer 17c abuts against the outer periphery of the helical spline 2a of the gear shaft 2 with the front end of the preventive stopper 17g confronting the rear end of the inner clutch base portion 5a. Thus the stopper 17g blocks the retracting movement of the clutch by hitting the base portion 5a if the latter retracts prematurely. When the motor is turned off and the centrifugal force diminishes, the governor weight returns to the initial position due to the bias force given by the compression spring 18, by which the stopper 17g is kept away from the retracting passage of the inner clutch base portion 5a.

With this arrangement according to the second embodiment, the governor weight means 17 prevents premature retracting movement of the rotatable clutch 4 by shifting in one radially outward direction or eccentrically. The governor weight means may be formed by bending a metal blank plate with a press in a conventional simple procedure. In addition, the position-restoring device may be composed of a common compression coil spring commercially traded in the market in this embodiment. Further this device can be suitably accommodated within a room defined jointly by portions of the weight means and the bracket, thus requiring a reduced number of parts, which enables simplification of the whole structure of the engine starter mechanism.

For variation, the clutch may include a pair of inner and outer clutch members such that the inner member is provided with a pinion gear for rotating the input gear to start the engine, while the outer member has a base portion to abut against the eccentrically displaced governor weight member for prevention of premature retracting movements.

Alternatively the governor weight means may be composed of two weight balancers made of materials of mutually different specific gravity to the degree the center of gravity of the governor weight is positioned radially eccentric.

Additional consideration has to be made for rotation balance of the governor weight if the motor driven gear shaft rotates at an extraordinary high velocity, although this is not necessary for motors rotating at an ordinary velocity. For this purpose a third embodiment of the present invention is proposed as described hereinbelow. In this embodiment, as shown in FIGS. 10A–11B, the bracket 12 has a wall 12*a* with a thickened portion 12*b* at the position corresponding to the second weight balancer 13*c* in alignment therewith. Thickened portion 12*b* is formed so as to partially offset the imbalance caused by eccentric disposition of the center of gravity of the governor weight means 13, thereby moderating the excessive rotational imbalance caused by extraordinary fast rotation.

For the same purpose, the thickened flange portion may be alternatively sufficed by providing a third weight balancer for moderating the degree of weight imbalance of the governor. This third balancer can be mounted additionally on the outer or inner periphery of the flanged portion of the bracket.

What is claimed is:

1. A governor system, for engine starter mechanisms including: a gear shaft connected to and driven by a motor for rotation; a single-direction rotatable clutch operatively engaged with the gear shaft via a helical spline such that the clutch rotates together with the gear shaft when the gear shaft is driven to rotate and the clutch moves forward axially along the gear shaft due to angular momentum to transmit the rotation of the gear shaft via a pinion gear disposed at a front end of the clutch to the engine, thereby starting the engine, and when the gear shaft is inactive, the clutch rotates only in an idling manner without transmitting the rotation, the governor system for preventing a premature retracting movement of the clutch, comprising:

an integral governor weight fixed axially relative to the gear shaft and movable in a radial direction relative to the gear shaft due to a centrifugal force caused by the rotation of the gear shaft;

and a resilient position-restoring device urging said governor weight to an initial retracted position when the centrifugal force diminishes;

said governor weight having an annular shaped body in which a base portion of the clutch is received when the governor weight is in the initial retracted position, and the base portion of the clutch being movable into and out of the annular shaped body in the axial direction parallel to the gear shaft; and said governor weight having a center of gravity that is eccentric or located off the central axis of the governor weight in one radial direction so that the centrifugal force of rotation causes the governor weight to shift in said one radial direction, and thus a portion of the governor weight that is disposed at a side opposite to said one radial direction moves toward the gear shaft thereby preventing the premature axial retracting movement of the clutch.

2. The governor system according to claim 1, wherein said governor weight includes a heavier weight portion disposed radially eccentric in said one radial direction and a lighter weight portion disposed radially opposite to the heavier weight portion, so that said governor weight shifts in said one radial direction when the governor weight rotates, thereby bringing said lighter weight portion to a position to block the retraction movement of the clutch.

3. The governor system according to claim 1, wherein said governor weight is disposed slidably movably in the radial direction on a bracket which rotates integrally with the gear shaft, and said bracket is provided with a guide for guiding said governor weight to shift in said one radial direction.

4. The governor system according to claim 3, wherein said governor weight includes a heavier weight portion disposed radially eccentric in said one radial direction and a lighter weight portion disposed radially opposite to the heavier weight portion, so that said governor weight shifts in said one radial direction when the governor weight rotates, thereby bringing said lighter weight portion to a position to block the retraction movement of the clutch.

5. The governor system according to claim 3, wherein said resilient position-restoring device is received in a device receptacle room defined between the bracket and the governor weight at one side of the central axis of the governor weight in said one radial direction.

6. The governor system according to claim 5, wherein said device receptacle room is surrounded on all four sides jointly by a first side wall portion extending in the axial direction from a top end of a standing wall of the governor weight rising from said heavier weight portion at a radially outward half-way position, a second flat portion of a bottom plate of the bracket confronting said first side wall portion, and third and fourth side wall portions standing from the bracket bottom plate and disposed along a circumference of the bracket bottom plate, and confronting both side edges of said standing wall of the governor weight, said standing wall of the governor weight and a flanged portion of the bracket standing in the axial direction from the periphery of the bracket bottom plate jointly defining pressure walls for said position-restoring device received in said receptacle room.

7. The governor system according to claim 6, wherein said third and fourth side wall portions also serve as a guide for guiding the governor weight to shift in the radial direction.

8. The governor system according to claim 3, wherein said bracket includes an eccentric third weight portion to partially offset a radial imbalance created by said governor weight.

9. A governor system for preventing a premature retracting movement of a clutch that is operatively engaged with a gear shaft within an engine starter mechanism, said governor system comprising:

an annular shaped body, said annular shaped body having a central opening therethrough for passage of the gear shaft and for clearance around a portion of the clutch during retracting movement of the clutch;

said annular shaped body having a center of gravity that is displaced radially relative to a central axis of the gear shaft, and said annular shaped body being slidably supported by a bracket for radial movement perpendicular to the gear shaft while being prevented by the bracket from movement relative to the gear shaft in an axial direction parallel to the gear shaft; and a biasing means for urging said annular shaped body in a radial direction perpendicular to the gear shaft toward a radially inward position where said central opening provides clearance for the portion of the clutch during retracting movement of the clutch and away from a radially outward position where said annular shaped body blocks retracting movement of the clutch.

10. The governor system according to claim 9, wherein said bracket is mounted for rotation with the gear shaft and has integral guide portions that slidably support said annular body for radial movement perpendicular to the gear shaft.

11. The governor system according to claim 10, wherein said biasing means is received in a compartment defined between portions of said bracket and said annular shaped body.

12. The governor system according to claim 11, wherein said compartment defining portions include said integral guide portions.

13. The governor system according to claim 10, wherein said bracket includes an eccentric weight portion for counterbalancing said annular shaped body.

14. The governor system according to claim 9, wherein said annular shaped body includes a heavier weight portion disposed radially eccentric toward said biasing means and a lighter weight portion disposed radially opposite to said heavier weight portion such that rotation of said governor system causes said annular shaped body to move opposite to said radial direction against said biasing means.

* * * * *